US008046970B2

(12) United States Patent
Diniz et al.

(10) Patent No.: US 8,046,970 B2
(45) Date of Patent: Nov. 1, 2011

(54) UNGUYED TELESCOPING TOWER

(75) Inventors: Ronald L. Diniz, Vero Beach, FL (US); Craig A. Davis, Vero Beach, FL (US)

(73) Assignee: Aluma Tower Company, Inc., Vero Beach, FL (US)

( * ) Notice: Subject to any disclaimer, the term of this patent is extended or adjusted under 35 U.S.C. 154(b) by 39 days.

(21) Appl. No.: 12/418,004

(22) Filed: Apr. 3, 2009

(65) Prior Publication Data

US 2010/0251634 A1 Oct. 7, 2010

(51) Int. Cl.
*E04H 12/18* (2006.01)

(52) U.S. Cl. .... 52/632; 52/123.1; 52/651.01; 52/651.07

(58) Field of Classification Search ..... 52/632, 52/651.01, 651.07, 123.1, 121, 831, 745.17
See application file for complete search history.

(56) References Cited

U.S. PATENT DOCUMENTS

| | | | | |
|---|---|---|---|---|
| 2,942,700 | A * | 6/1960 | Parmenter et al. | 52/121 |
| 3,047,107 | A * | 7/1962 | Parmenter et al. | 52/121 |
| 4,166,542 | A * | 9/1979 | Bryan, Jr. | 212/231 |
| 4,478,014 | A * | 10/1984 | Poock et al. | 52/115 |
| 4,590,720 | A * | 5/1986 | Reed | 52/121 |
| 5,537,125 | A | 7/1996 | Harrell, Jr. et al. | |
| 6,883,643 | B2 * | 4/2005 | Robillard | 182/146 |
| 7,231,741 | B2 * | 6/2007 | Norwood | 52/118 |
| 7,574,832 | B1 * | 8/2009 | Lieberman | 52/118 |

* cited by examiner

*Primary Examiner* — Brian Glessner
*Assistant Examiner* — Adam Barlow
(74) *Attorney, Agent, or Firm* — Myers Wolin, LLC

(57) ABSTRACT

A telescoping tower comprises a plurality of telescoping tower sections, each tower section having a pressure member that engages with a respective pressure member on a respective tower section when the tower sections are moved from a nesting condition to an extended position, the engagement of the pressure members occurring at the overlap of the tower sections to increase stability of the telescoping tower and reduce unwanted play at the overlap regions.

20 Claims, 10 Drawing Sheets

UNGUYED TELESCOPING TOWER

FIELD OF THE INVENTION

The present invention relates to a telescoping tower generally, and more particularly to an unguyed telescoping tower implementing a pressure bar system to impart stability to the tower structure.

BACKGROUND

Telescoping towers are traditionally used in areas unsuited for permanent tower installations such as in a military arena, a news hot spot, a disaster zone where existing communication lines have been temporarily or permanently disabled, and the like. Other uses include, but are not limited to, site surveys, testing and monitoring, data collection, and wireless data transfer. Most commonly, telescoping towers are used to facilitate the establishment of mobile communications in a relatively short period of time.

There are generally two known problems with mobile telescoping tower applications. First, as the height of the tower increases, the stability of both the tower and the interface or overlap between tower sections decreases. This is traditionally remedied with guy wires or the like. However, the process of installing guy wires can add an average of an hour to the installation and possibly require additional manpower, which are time and resources that are usually unavailable in an emergent or crisis situation, and which results in the second problem.

These two problems are resolved through the use of unguyed towers. By eliminating the need for guy wires, the time spent on guy wire installation can be better utilized during crucial emergency instances where communication towers are vital. Furthermore, unguyed towers can be advantageous where the use of guy wires and anchors are not feasible. Specific applications where guy wire use would be obstructed include urban areas with many buildings, near bodies of water, presence of underground cables or pipes, heavily wooded areas or hard, rocky ground.

There is a need, therefore, for an unguyed tower that can be erected quickly and efficiently, and that is stable at heights that traditionally require guy wire support. This need is met by the telescoping tower of the present disclosure.

SUMMARY

A telescoping tower having a plurality of telescoping tower sections is provided with pressure bar assemblies on each tower section. When a first tower section is extended relative to a second tower section, a pressure bar assembly on one side of the first tower section engages with another pressure bar assembly on a mating side of the second tower section at the overlap between the two tower sections, with the engagement of the pressure bar assemblies causing a pressure or force to act on the other sides of the first and second tower section to close the gap and thereby reduce unwanted play between such respective tower sections. The increased pressure at the overlap results in increased stability of the telescoping tower as a whole and enables the tower to withstand environmental challenges in an unguyed condition.

DETAILED DESCRIPTION OF THE PREFERRED EMBODIMENTS

Figure 1:
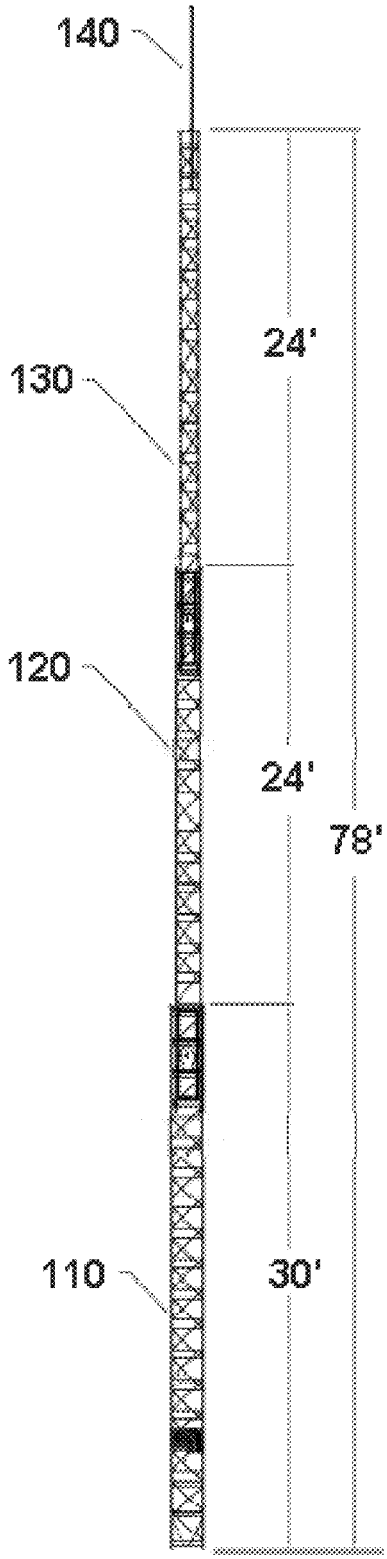
FIG. 1 is one embodiment of an erected telescoping tower in accordance with the present invention.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1 illustrates one embodiment of an erected telescoping tower 100 formed generally from a first section 110, a second section 120, and a third section 130. A mast 140 may extend from the third section 130 for supporting an antenna or some other data collection device. Other attachments are contemplated. In the embodiments described herein, a telescoping tower 100 of triangular cross-section will be used for purposes of illustration, it being understood that other cross-sectional configurations are within the scope of the present disclosure. It will also be appreciated that while three tower sections are shown, it will be understood that a telescoping tower in accordance with the present disclosure can have as few as two sections and more than three sections if desired. The size, shape, length and cross-section configurations described herein are illustrated for purposes of example and are not intended to be limiting. However, for purposes of explanation and by way of example only, for an illustrated seventy-eight foot tower installation, each tower section would have a height of thirty feet with a six foot overlap at the transition between each tower section, resulting in the first section 110 having a visible height of thirty feet, and the second and third tower sections 120, 130 each having a visible height of twenty-four feet. Of course, other dimensions, overlaps, etc., are contemplated to meet specific environmental demands.

Figure 2:
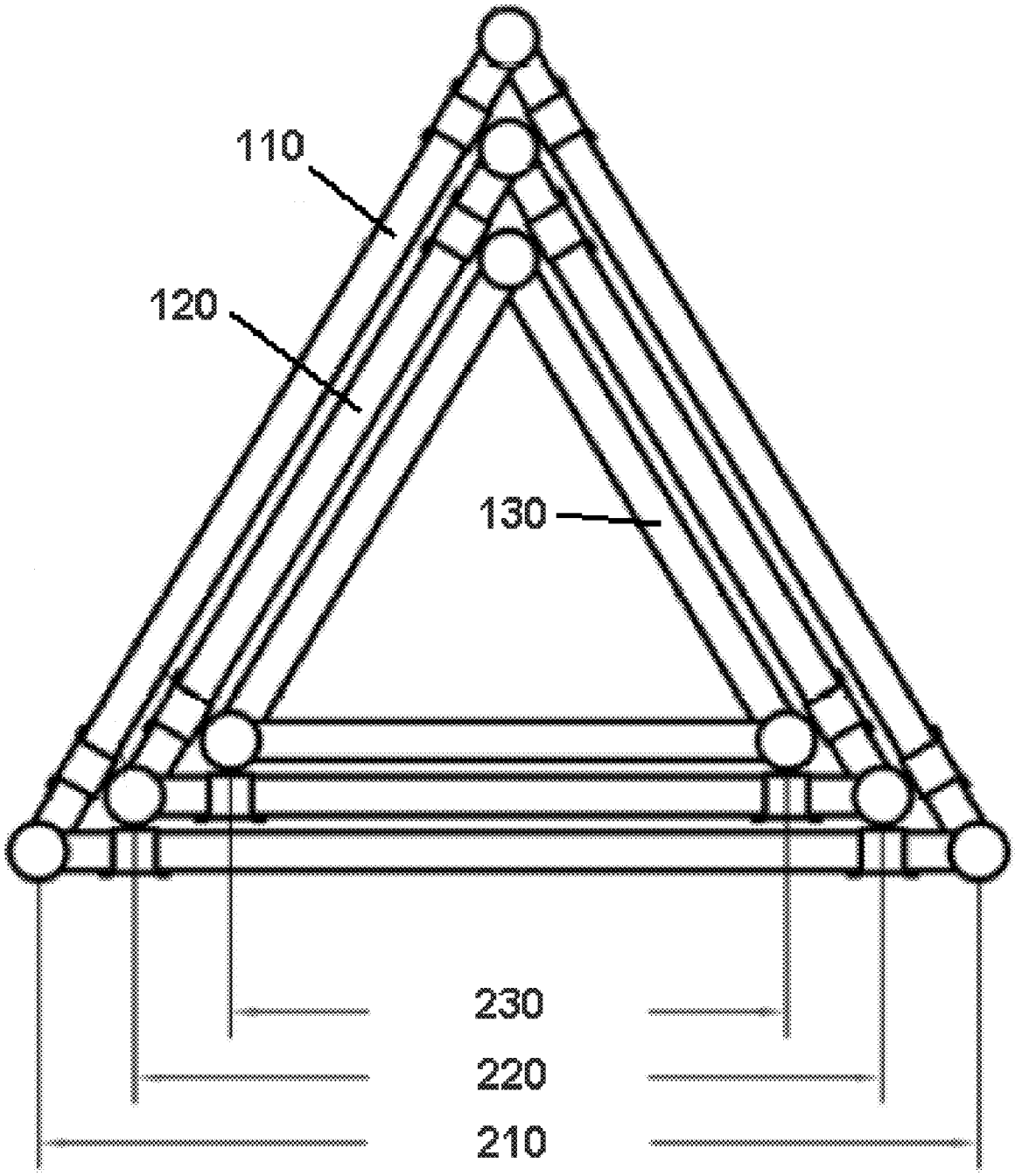
FIG. 2 is one embodiment of a telescoping tower in a nested condition.

As shown in FIG. 2, which illustrates a schematic, nested view of the tower sections 110, 120 and 130, the first section 110 has the largest width 210, the third section 130 has the smallest width 230, and the second section 120 has a width 220 that is between the first and third widths 210, 230. In certain embodiments, the first section 110 might be anchored to a base of some sort, a fixed building, a portable trailer structure or the like (all not shown). However, for purposes of this discussion, the anchoring of the telescoping tower to the ground or some other support structure will not be illustrated or described in detail, it being understood that a variety of anchoring means now known or hereinafter developed may be utilized as desired.

Each of the tower sections 110, 120, 130 will now be described in more detail in FIGS. 3A-5 as first, second and third tower sections 300, 400 and 500. Each tower section generally has three sides, with first tower section 300 (FIG. 3A) having sides 310, 320, 330 and second tower section 400 (FIG. 4) having sides 410, 420, 430 and third tower section 500 (FIG. 5) having sides 510, 520, and 530. Each side has an interior that faces the other sides, and an exterior that faces away from the respective tower section. In a nested condition, when the three tower sections 300, 400, 500 are fully collapsed, the exterior of the second tower section 400 faces the first tower section 300, and the exterior of the third tower section 500 faces the second tower section 400.

Figure 3A:
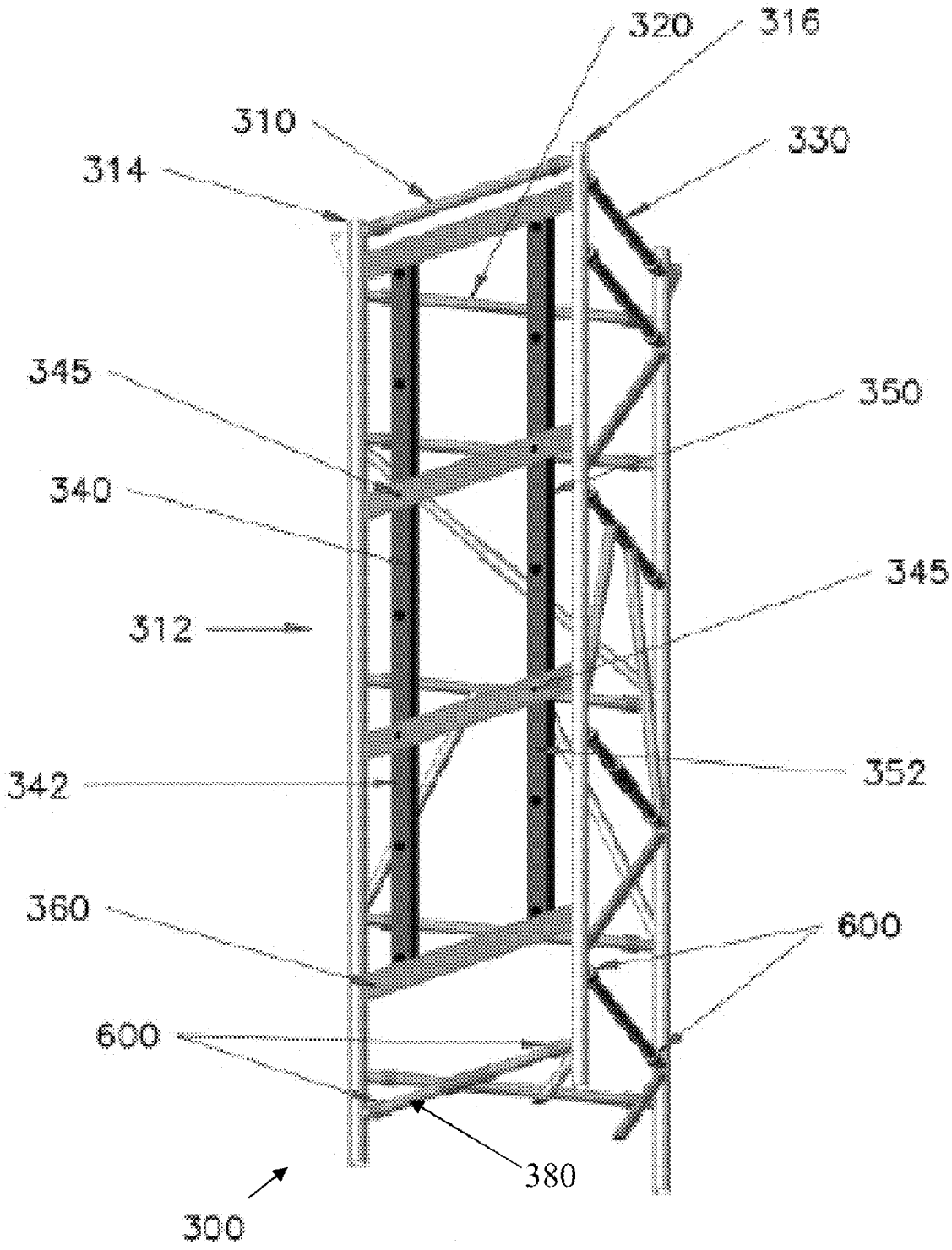
FIG. 3A is one embodiment of one section of a telescoping tower.
Figure 3B:
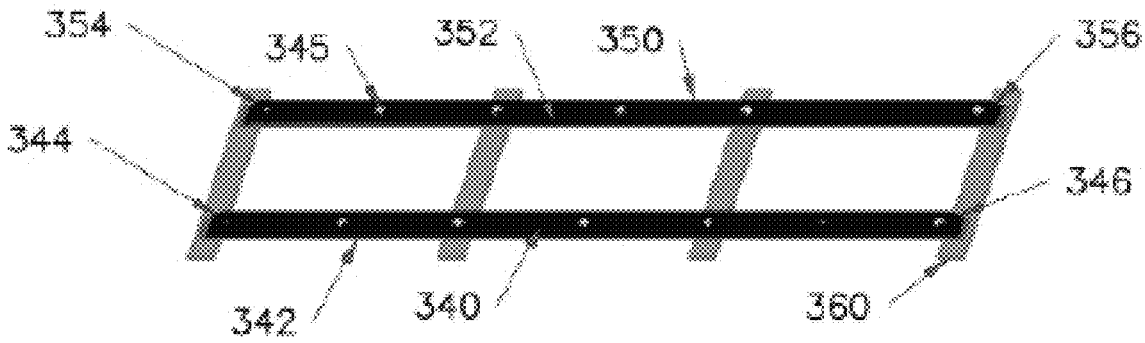
FIG. 3B is one embodiment of a portion of the section of FIG. 3A.

Positioned along an upper section 312 (only the upper section 312 of tower section 300 is shown in FIG. 3A for clarity) of the interior of side 310 of the first section 300 is preferably a pair of pressure bars 340, 350 supported on the side 310 by a plurality of horizontally-aligned, vertically-spaced rungs 360. FIG. 3B illustrates a close up view of the pressure bar arrangement shown in FIG. 3A shown from the interior of the tower section 300. While a pair of pressure bars is preferred and shown in the embodiments discussed herein for purposes of explanation, it will be appreciated that at least one and more than two pressure bars can be utilized as desired. Similarly, while the pressure bars are situated on certain illustrated sides, it will be appreciated that other sides may be used as long the relative engagement of pressure bars between tower sections is maintained as will be described in more detail.

More specifically, each pressure bar 340, 350 is preferably formed from a static-dissipative ultra-high molecular weight (UHMW) polyethylene rectangular material with a low coefficient of friction, high impact strength and weather resistance. Of course, other types of materials are contemplated. In one example where the first tower section 300 is approximately thirty feet long, each pressure bar 340, 350 is preferably two inches wide, one-half inch thick and sixty inches (five feet) long, and is bolted at a plurality of locations with countersunk bolts 345 to further support bars 342, 352, that are then welded or otherwise fixed to laterally extending rungs 360, that are then welded or otherwise fixed to the longitudinally-extending side frames 314, 316 that form the side 310 (see FIGS. 3A and 3B). In the illustrated embodiment, these horizontal rungs 360 replace the traditional horizontal and diagonal rungs present along the remainder of the side 310.

Figure 4:
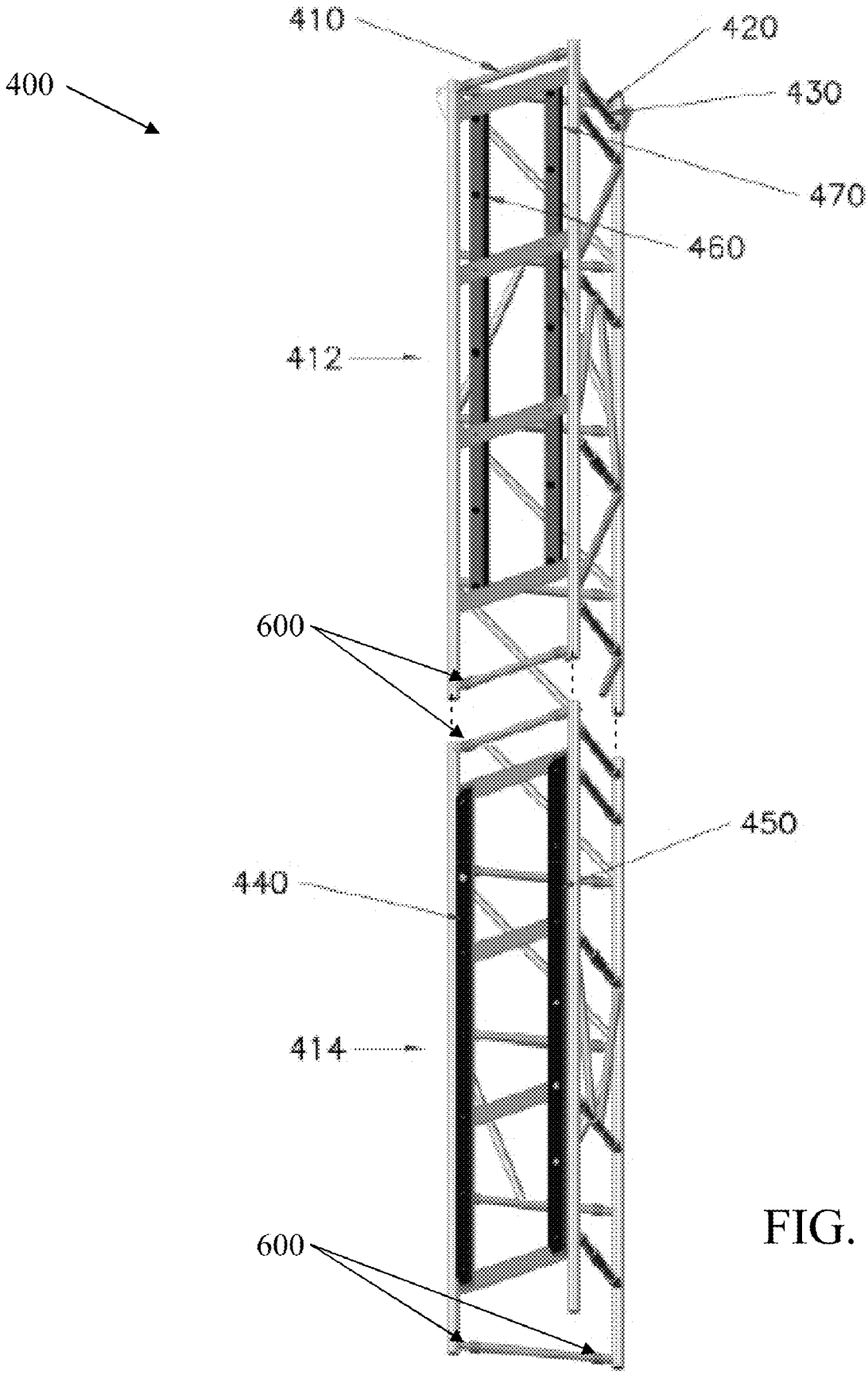
FIG. 4 is one embodiment of one section of a telescoping tower.
Figure 5:
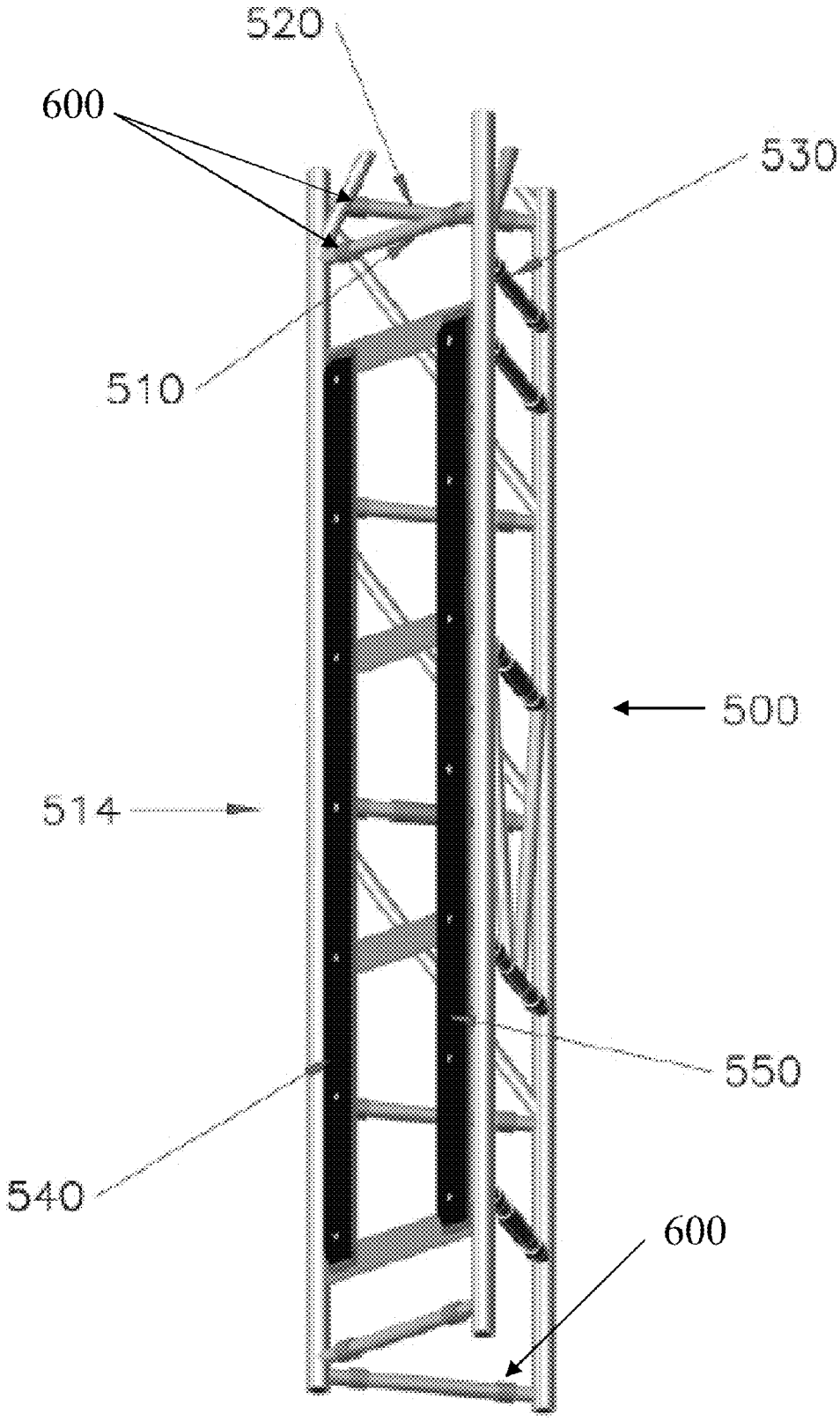
FIG. 5 is one embodiment of one section of a telescoping tower.

Similar pressure bar assemblies are provided on the second and third tower sections 400, 500 as shown in FIGS. 4 and 5. More specifically on the second tower section 400, pressure bars 440, 450 are situated on an exterior side of a lower section 414 of side 410 in a facing relationship with side 310 of the first tower section 300, and additional pressure bars 460, 470 are situated on an interior side of an upper section 412 of side 410 in a facing relationship with side 510 of the third tower section 500, with only the upper and lower sections 412, 414 of the tower section 400 being shown for clarity. On the third tower section 500 (only the lower section 514 of tower section 500 shown in FIG. 5 for clarity), pressure bars 540, 550 are situated on an exterior side of a lower section 514 of side 510 in a facing relationship with side 410 of the second tower section 400.

Returning to FIG. 3, the pressure bars 340, 350 are positioned along the upper section 312 of the interior side 310 of the first section 300 because such region forms the overlap between the first and second tower sections 300, 400 when the second tower section 400 is extended relative to the first tower section 300. The overlap region is traditionally the region of greatest concern from the perspective of the tower as a whole, since the overlap constitutes an effective joint in the tower structure, and there is typically some play that exists between tower sections at the overlap region. Excessive play at the overlap can increase the instability of the entire tower particularly during undesirable environmental conditions. It is for this reason that the pressure bars are preferably disposed at the overlap regions. Thus, with a six foot overlap between tower sections, for example, the pressure bars 340, 350 would preferably occupy five of the last six feet of height of the first tower section 300, with a one foot offset preferably provided to accommodate different installation spacing. Similarly, pressure bars 440, 450 of the second tower section 400 would preferably occupy five of the first six feet of height of such tower section, while pressure bars 460, 470 would occupy five of the last six feet of height of such tower section.

Figure 6A:
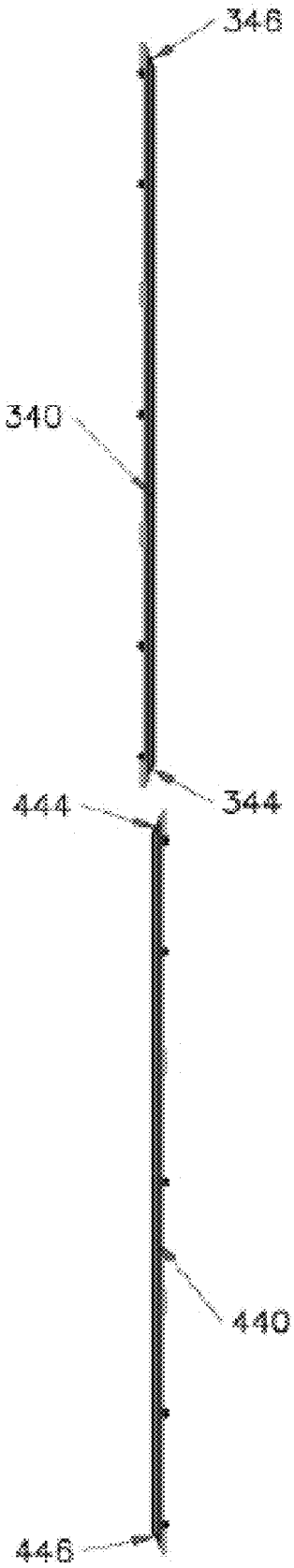
FIGS. 6A-6D are schematic illustrations of one embodiment of the engagement of pressure bars of two tower sections.
Figure 6C:
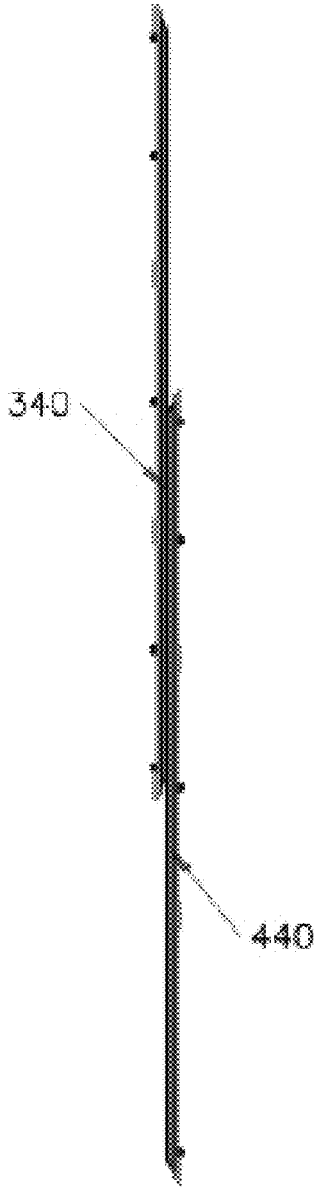
Figure 6D:
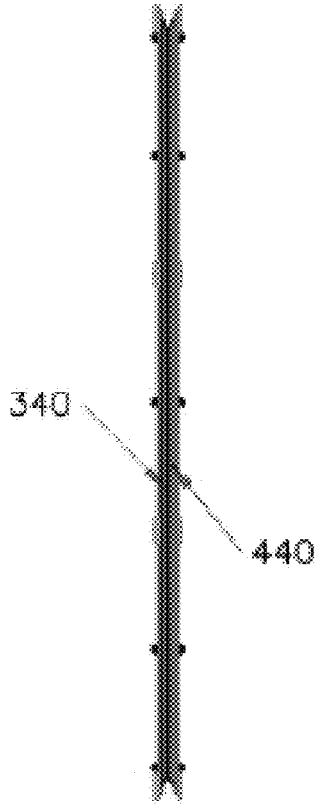
Figure 6B:
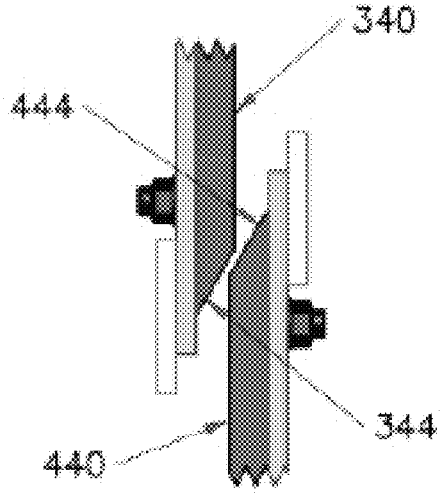

FIGS. 6A-6D illustrates the engagement of pressure bar 340 of tower section 300 with pressure bar 440 of tower section 400, it being understood that pressure bars 350 and 450 would simultaneously engage with the engagement of pressure bars 340, 440. For purposes of illustration, the third tower section 500 will not be shown and only pressure bars 340, 440 will be shown for illustration even though pressure bars 350, 450 will also be described below. As shown in FIG. 6A, when tower section 400 is extended relative to tower section 300, the pressure bars 440, 450 approach pressure bars 340, 350 along a collision course. In order to facilitate mounting engagement of the two pressure bar assemblies, each pressure bar is provided with a tapered edge 344, 346, 354, 356, (see also FIG. 3B) 444, 446, 454, 456 that acts as a cam to allow the pressure bars to ramp up on each other as shown in FIG. 6B. Once the pressure bars are in respective planar engagement (FIG. 6C), the pressure bars 440, 450 continue to advance over pressure bars 340, 350 with the continued extension of the second tower section 400 relative to the first tower section 300 until the pressure bar assemblies are effectively in parallel alignment and there is sufficient overlap between the first and second tower sections as shown in FIG. 6D. As will be appreciated, the sliding engagement of the pressure bar assemblies is aided by the low coefficient of friction material and the countersunk bolts used to secure the pressure bars to the support plates.

Figure 7:
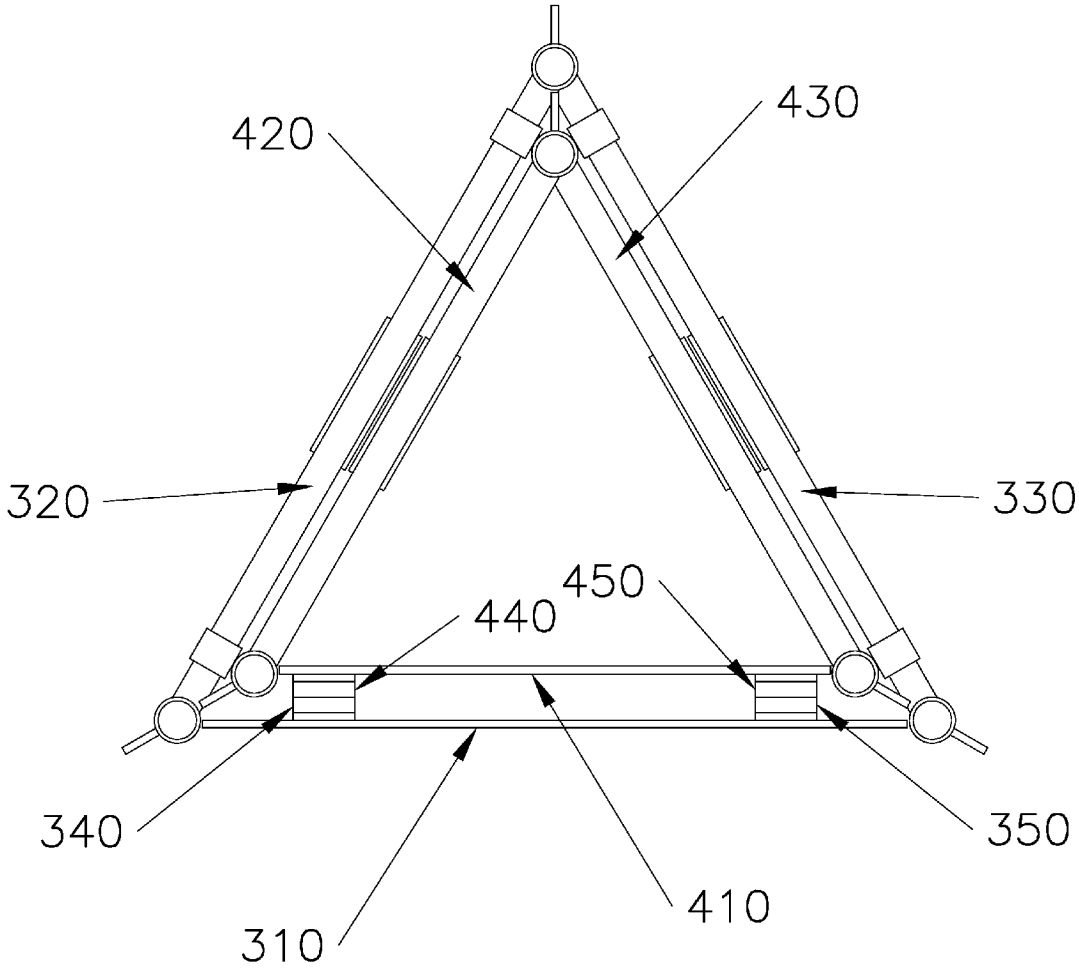
FIG. 7 is a schematic illustration of a two section tower.

As shown in FIG. 7, the engagement of the pressure bar assemblies along sides 310, 410 forces the other two sides 420, 430 of the second tower section 400 against the other two sides 320, 330 of the first tower section 300 in order to close the gap that normally exists between the tower sections and that enables the tower sections to freely move relative to each other. This additional pressure exerted across all three sides of each tower section at the overlap between the tower sections imparts a measurable increase in stability throughout such overlap region and thereby reduces the play between the two tower sections that might otherwise be problematic in certain adverse environmental conditions. This also imparts additional stability to the entire telescoping tower structure as the two tower sections effectively function as a unified tower section, which also enables the tower section to be erected without guy wires and the like.

Figure 8:
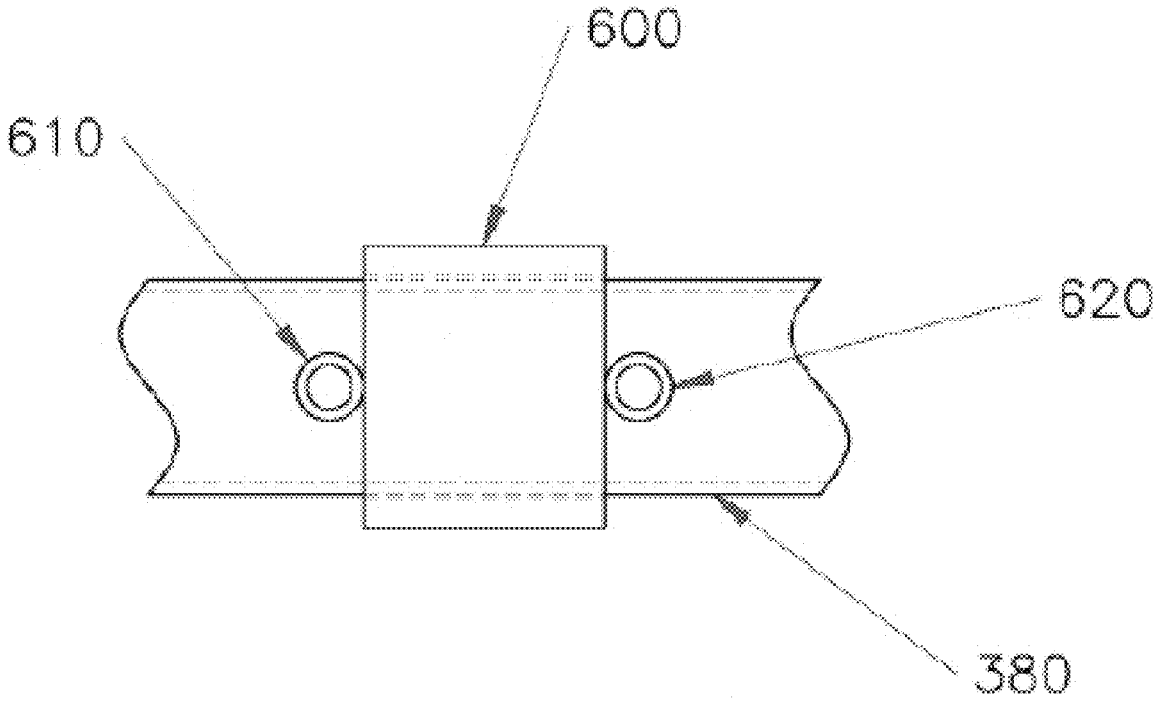
FIG. 8 is one embodiment of a rung implemented roller.

In order to accommodate the relative movement of the tower sections while the pressure bar assemblies are engaged, given that such engagement causes the tower sections to effectively be forced together, rollers 600 (FIGS. 3-5) are provided on rungs (FIGS. 3A-5) at strategic locations relative to the force applied by the pressure bars so as to provide the maximum length of support. As shown in FIG. 8, a roller 600 is typically formed from a cylindrical collar that is situated on a rung 380 (see FIG. 3A, for example) between a pair of stops 610, 620. The roller 600 may be a single cylindrical collar or it may be formed from multiple collars placed in series. Other roller configurations are contemplated. The rollers 600 accommodate the sliding movement of the tower sections relative to each other. Without the rollers 600, the tower sections might get damaged or be prevented from moving relative to each other as a result of the increased pressure imparted by the engagement of the pressure bar assemblies.

In a preferred embodiment, all of the tower sections 300, 400, 500 are moved simultaneously via a cabled rigging disposed between the tower sections. In other words, in such an embodiment, while the second tower section 400 is erected relative to the first tower section 300, and the pressure bar assemblies 340, 350 are engaged with pressure bar assemblies 440, 450, the same process occurs simultaneously with respect to the erection of the third tower section 500 relative to the second tower section 400. Thus, as the second tower section 400 is moving relative to the first tower section 300, the third tower section 500 is moving relative to the second tower section 400, which, in such embodiment, allows the tower assembly to be erected rather quickly. During extension of the third tower section 500 relative to the second tower section 400, the pressure bars 540, 550 approach pressure bars 460, 470 and initiate engagement with the assistance of cam surfaces. Once the pressure bars are in respective planar engagement, the pressure bars 540, 550 continue to advance over pressure bars 460, 470 with the continued extension of the third tower section 500 relative to the second tower section 400 until the pressure bar assemblies are effectively in parallel alignment and there is sufficient overlap between the second and third tower sections. When the second and third tower sections are fully extended and the pressure bar assemblies are fully engaged at the overlap regions of the tower sections, the entire tower functions as a single unit with increased overall stability. While simultaneous movement of the tower sections is preferred, non-simultaneous movement may be contemplated if desired.

In order for the pressure bar assemblies to impart sufficient force on the tower sections to increase the structural integrity at the overlap sections and for the tower as a whole, the pressure is preferably great enough such that the tower will not collapse under the force of gravity alone. In other words, in the described embodiment, the tower sections will preferably need to be pulled apart when it is desired to return the tower to its fully nested condition for storage or transport or the like.

Figure 9:
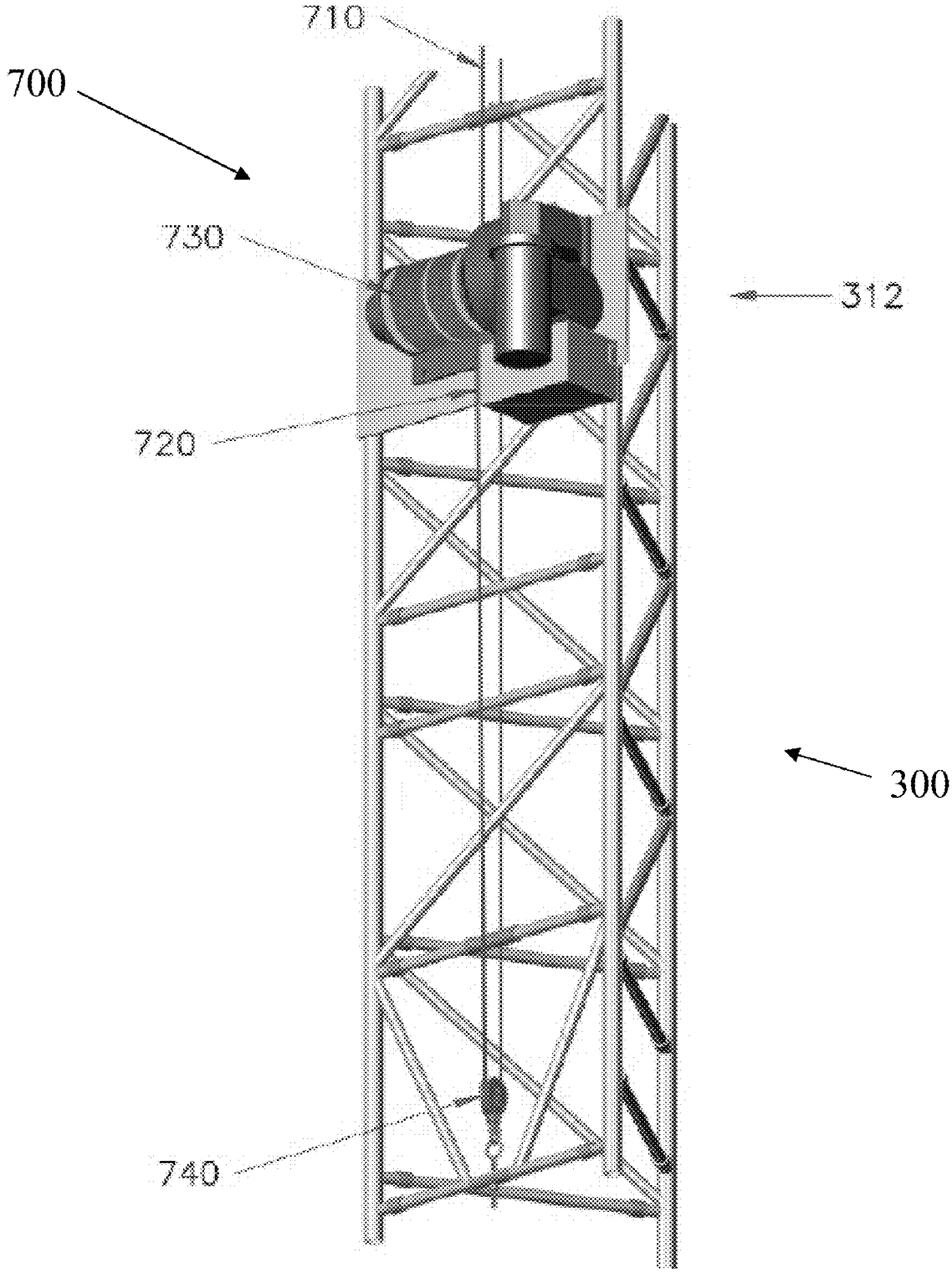
FIG. 9 is one embodiment of a drive structure implemented in the present disclosure.

FIG. 9 illustrates one embodiment of a drive structure 700 that may be attached to the first tower section 300 to aid in the separation of the tower sections. While FIG. 9 illustrates the attachment of the drive 700 to the first tower section 300, it will be appreciated that other attachment scenarios are possible, that are either connected to a tower section or anchored to something apart from the tower such as a nearby building, support trailer or the like. More specifically, in this embodiment, drive structure 700 is a winch that simultaneously uses two separate cables 710, 720, each moving in the opposite direction, on a single grooved drum 730. In other words, when cable 710 is being fed from the drum 730, the other cable 720 is being fed onto the drum 730, and vice versa, which enables the winch to move the tower sections relative to each other, either during erection or disassembly of the tower. While a single-drum winch is preferred, it will be appreciated that other drive structures are contemplated. In addition, the drum 730 is preferably grooved to insure that the cables track correctly. A series of pulleys 740 (only one being shown for purposes of example) are strategically positioned throughout the tower sections to accommodate the cables 710, 720 and create the appropriate rigging necessary to quickly and efficiently, and preferably simultaneously, raise and lower a telescoping tower assembly. More specifically, in a preferred arrangement, each respective cable 710, 720 is associated, through a rigging assembly, with a respective tower section, for purposes of erecting one tower section relative to its adjacent tower section by pulling such respective tower sections relative to each other, and similarly, for pulling such tower sections apart when it is desired to disassemble the tower sections into their nested condition.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A telescoping tower comprising:

a) a first tower section having a first pressure member mounted on a length of a rung on a flat side of the first tower section and a first overlap region; further comprising a corner member at the end of each rung and the first pressure member mounted between two corner members and b) a second tower section having a second pressure member mounted on a length of a rung on a flat side of the second tower section and a second overlap region and being movable relative to the first tower section from a nested position to an extended position, further comprising a corner member at the end of each rung and the second pressure member mounted between two corner members wherein the space to be occupied by the second pressure member is at least partially common to the space occupied by the first pressure member when in the extended position;

c) wherein the second pressure member engages the first pressure member upon movement of the second tower section from the nested position to the extended position such that the first and second pressure members give way relative to each other over the at least partially common space to increase stability of the telescoping tower and reduce unwanted play between the first and second overlapping regions by causing a pressure or force to act between a rung of the first tower section and a rung of the second section on the other flat sides of the first and second tower section respectively; and d) wherein the increased stability at the overlapping regions prevents disengagement of the first and second pressure members through gravity alone.

2. The telescoping tower of claim 1, wherein the first and second pressure members are respectively situated in the first and second overlap regions.

3. The telescoping tower of claim 1, wherein the first pressure member is situated on an inner side of the first tower section, and the second pressure member is situated on an outer side of the second tower section.

4. The telescoping tower of claim 1, wherein at least one pressure member has a cam surface to facilitate the initial engagement of the pressure members.

5. The telescoping tower of claim 1, further comprising a drive member that moves the second tower relative to the first tower.

6. The telescoping tower of claim 5, wherein the drive member further comprises a winch having a drum, a first cable attached to the drum, and a second cable attached to the drum, the first and second cables being movable in opposite directions relative to the drum for moving the tower sections relative to each other.

7. The telescoping tower of claim 6, wherein the drum is grooved to facilitate tracking of the first and second cables.

8. The telescoping tower of claim 1, wherein each pressure member further comprises a static-dissipative, ultra-high molecular weight (UHMW) polyethylene material.

9. The telescoping tower of claim 1, wherein each pressure member is attached to its respective tower section with countersunk fasteners.

10. The telescoping tower of claim 1, further comprising rollers to accommodate relative sliding movement of the tower sections during engagement of the pressure members.

11. The telescoping tower of claim 10, wherein the rollers are situated on rungs on each tower section.

12. The telescoping tower of claim 11, wherein the pressure members are situated on one side of each tower section and the rollers on rungs are situated on at least one other side of each tower section.

13. A telescoping tower comprising:

a) a first tower section having a first pressure member mounted on a length of a rung on a flat side of the first tower section in a first overlap region; further comprising a corner member at the end of each rung and the first pressure member mounted between two corner members b) a second tower section having a second pressure member mounted on a length of a rung on a flat side of the second tower section in a second overlap region and being movable relative to the first tower section from a nested position to an extended position, further comprising a corner member at the end of each rung and the second pressure member mounted between two corner members wherein the space to be occupied by the second pressure member is at least partially common to the space occupied by the first pressure member when in the extended position; and c) a drive member that moves the second tower relative to the first tower;

d) wherein the second pressure member engages the first pressure member, through a cam surface on at least one of the first and second pressure members, upon movement of the second tower section from the nested position to the extended position such that the first and second pressure members give way relative to each other over the at least partially common space to increase stability of the telescoping tower and reduce unwanted play between the first and second overlapping regions and prevent disengagement of the first and second pressure members through gravity alone by causing a pressure or force to act between a rung of the first tower section and a rung of the second section on the other flat sides of the first and second tower section respectively; and e) wherein the drive member is used to disengage the first and second pressure members when it is desired to return the second tower section to the nested position.

14. The telescoping tower of claim 13, wherein the first pressure member is situated on an inner side of the first tower section, and the second pressure member is situated on an outer side of the second tower section.

15. The telescoping tower of claim 14, wherein the drive member further comprises a winch having a grooved drum, a first cable attached to the drum, and a second cable attached to the drum, the first and second cables being movable in opposite directions relative to the drum for moving the tower sections relative to each other.

16. The telescoping tower of claim 13, wherein each pressure member further comprises a static-dissipative, ultra-high molecular weight (UHMW) polyethylene material.

17. The telescoping tower of claim 13, further comprising rollers to accommodate relative sliding movement of the tower sections during engagement of the pressure members.

18. A telescoping tower comprising a first tower section having a first pressure member mounted on a length of a rung on a flat side of the first tower section and a first overlap region; further comprising a corner member at the end of each rung and the first pressure member mounted between two corner members and a second tower section having a second pressure member mounted on a length of a rung on a flat side of the second tower section and a second overlap region; and a drive member that moves the second tower relative to the first tower from a nested position to an extended position, further comprising a corner member at the end of each rung and the second pressure member mounted between two corner members wherein the space to be occupied by the second pressure member is at least partially common to the space occupied by the first pressure member when in the extended position; and further comprising a drum, a first cable attached to the drum, and a second cable attached to the drum, the first cable runs off from the top of the drum and the second cable runs off from the bottom of the drum, the first and second cables being movable in opposite directions relative to the drum for moving the tower sections relative to each other; wherein the second pressure member engages the first pressure member upon movement of the second tower section from the nested position to the extended position such that the first and second pressure members give way relative to each other over the at least partially common space to increase stability of the telescoping tower and reduce unwanted play between the first and second overlapping regions by causing a pressure or force to act between a rung of the first tower section and a rung of the second tower section on the other flat sides of the first and second tower section respectively.

19. The telescoping tower of claim 18, wherein the drum is grooved to facilitate tracking of the first and second cables.

20. The telescoping tower of claim 18, further comprising a third tower section that is movable relative to the second tower section simultaneously with the movement of the second tower section relative to the first tower section.

* * * * *